United States Patent [19]

Neyer

[11] Patent Number: 5,038,543

[45] Date of Patent: Aug. 13, 1991

[54] STANDING SEAM ROOF ASSEMBLY

[75] Inventor: Leo E. Neyer, Spokane, Wash.

[73] Assignee: ASC Machine Tools, Inc., Spokane, Wash.

[21] Appl. No.: 498,565

[22] Filed: Mar. 23, 1990

[51] Int. Cl.[5] ..... E04D 1/00

[52] U.S. Cl. ..... 52/528; 52/428; 52/588

[58] Field of Search ..... 52/519, 528, 478, 588, 52/671, 544, 545, 537

[56] References Cited

U.S. PATENT DOCUMENTS

| | | | |
|---|---|---|---|
| 3,982,373 | 9/1976 | Wilson et al. | 52/528 X |
| 4,269,012 | 6/1981 | Mattingly et al. | 52/394 |
| 4,495,743 | 1/1985 | Ellison et al. | 52/478 |
| 4,597,234 | 7/1986 | Simpson | 52/478 |
| 4,694,628 | 9/1987 | Vondergoltz et al. | 52/528 |
| 4,700,522 | 10/1987 | Simpson | 52/528 |

*Primary Examiner*—David A. Scherbel
*Assistant Examiner*—Creighton Smith
*Attorney, Agent, or Firm*—Bill D. McCarthy; Glen M. Burdick

[57] ABSTRACT

An improved female/male interlock seam assembly for a standing seam roof comprising a female side lap joint defining a male receiving cavity and a sealant cavity and a male side lap joint having a sealant engaging apex portion. The sealant cavity is characterized as having a first portion openly communicating with the male receiving cavity and a offset second portion adapted to receive and support a resilient sealant therein. The sealant engaging apex portion of the male side lap joint is provided with an outwardly extending nose-like portion so that in an assembled position the nose-like portion is substantially encapsulated by the sealant, and a force applied to the female/male interlock seam assembly compresses the sealant to enhance seam integrity.

9 Claims, 4 Drawing Sheets

STANDING SEAM ROOF ASSEMBLY

BACKGROUND OF THE INVENTION

1. Field of the Invention

The present invention relates generally to pre-engineered roof systems, and more particularly but not by way of limitation, to an improved standing seam roof assembly and components thereof.

2. Discussion of the Prior Art

In erecting a roof of a pre-engineered structure the established method is to erect the primary structural members, attach the secondary structural members to the primary structural members, and secure appropriate bracing members. Blanket-type or rigid insulation is then positioned across the secondary structural members and the roof panel members are positioned over the insulation. Thereafter, the roof panel members are connected to each adjacently disposed roof panel member and to the secondary structural members.

The prior art is replete with various types of roof assemblies which have heretofore been proposed for a pre-engineered roof system in an effort to provide a water-tight roof assembly, while at the same time enabling the roof assembly to expand and contract due to changes of temperature or forces applied to the roof assembly. Typical of such a prior art roof assembly which has been widely accepted in recent years is the standing seam roof assembly.

In a standing seam roof assembly the panel members are joined to each other along adjacent sides so that the sides are locked together to form the standing seams. The panel members are secured to the secondary structural members by clips that extend into the standing seam. The interconnection of the panel members and clips lends stiffness and strength to the roof structure, and permits the roof structure to expand and contract as a function of the coefficient expansion of the materials from which the roof panels are fabricated, as well as the temperature cycles to which the roof panels are exposed; independent of expansion and contraction of the secondary and primary structural members. The standing seam roof assembly is also subjected to other forces, such as wind uplift forces and load forces created by rain, snow or a workman walking on the roof panels.

Repeated occurrence of uplift and load forces on the panel members tends to weaken the panel-to-panel lap joint and causes the panels to separate which results in structural failure and leaks. Leaks in the roof assembly are usually caused by separation of the panel-to-panel lap joint from contact with the sealant used at the joints.

In an effort to overcome the deterioration of the panel-to-panel lap joint of the prior art roof assemblies, attempts have been made to modify the sealant employed to seal such joints in order to improve adhesion, flexibility and water repellency of the sealant. Further, the design of such joints has been such that the pressure on the sealant varied greatly at the clip locations throughout the length of the side lap joints of the panel which resulted in uneven distribution of pressure on the sealant and voids in the joints, either of which frequently led to leaks.

While advancement has been made in the design of roof assemblies for pre-engineered structures, and particularly in the design of the panel-to-panel lap joint, the need remains for an improved standing seam roof assembly which has a positive locking action with improved resistance to unsnapping, while reducing the critical tolerance requirements for sealant of the prior art panel-to-panel lap joints of the standing seam roof assemblies, and which provides a continually compressed gasket seal for the joint when the panels of the roof assembly are at rest, or when the panels are subjected to live loads, to uplift forces or to roof traffic. It is to such an improved standing seam roof assembly that the present invention is directed.

SUMMARY OF THE INVENTION

The present invention relates to an improved standing seam roof assembly for a building system, such as a pre-engineered metal building, in which roof panel members are disposed in a side-to-side interlocking relationship, and secured to the underlining building structural members. Broadly, the standing seam roof assembly comprises a roof panel member having a female side lap joint along one side of the roof panel member and a male side lap joint along an opposed second side thereof. The male and female side lap joints interlock with contiguously disposed roof panels of similar construction to provide on each side of the roof panel a female/male interlock seam assembly.

More specifically, the female side lap joint of the improved standing seam assembly of the present invention comprises a first leg extending substantially normal to a medial panel portion and a second leg angulary extensive from the first leg and forming a male receiving cavity therebetween. A distal end portion of the second leg defines a restraining lip which extends generally toward the first leg to partially block the opening of the male receiving cavity.

A sealant cavity is formed in an upper end portion of the female side lap joint, the sealant cavity having a first portion aligned with and openly communicating with the male receiving cavity and a second portion which is offset relative to the male receiving cavity of the female side lap joint. The offset second portion of the sealant cavity is adapted to supportingly receive a sealant such that the sealant extends a selected distance into the first portion of the sealant cavity.

The male side lap joint (which is positionable within the male receiving cavity of the female side lap joint in an interlocking relationship so as to resist disengagement that might occur by joint rotation or moment forces resulting from uplift forces or loads imposed on the roof panels) comprises a first leg extending substantially normal to the medial panel portion and a second leg angularly extensive from the first leg and forming a sealant engaging apex portion at the junction of the first and second legs thereof.

A distal end portion of the second leg of the male side lap joint defines a restraining lip engaging member adapted to abuttingly engage the restraining lip of the female lap joint when the male side lap joint is positioned within the male receiving cavity of the female side lap joint so as to interlock the male side lap joint and the female side lap joint.

The sealant engaging apex portion is desirably provided with a protruding or nose-like portion which extends outwardly therefrom in the direction of the offset second portion of the sealant cavity so that the protruding portion functions as a sealant engaging hook when the male side lap joint is disposed within the male receiving cavity of the female side lap joint.

As previously stated, the sealant cavity formed in an upper portion of the female side lap joint is provided with a second portion which is offset relative to the male receiving cavity and adapted to support the sealant therein. Thus, when the second leg of the female side lap joint is displaced laterally to permit entry of the male side lap joint into the male receiving cavity the sealant engaging apex portion of the male side lap joint can extend into the first portion of the sealant cavity substantially unrestricted by sealant disposed within the second portion of the sealant cavity until an assembled position of the female side lap joint and the male side lap joint is achieved. In the assembled position the restraining lip engaging member of the male side lap joint abuttingly engages the restraining lip of the female side lap joint, and the sealant is brought into compressive engagement with the protruding portion of the sealant engaging apex portion of the male side lap joint so that the protruding portion thereof is substantially encapsulated by the sealant.

Accordingly, and object of the present invention is to provide an improved standing seam roof assembly having interlocking side lap joints which resist disengagement by uplift wind forces imposed on the roof panels thereof.

Another object of the present invention, while achieving the above stated object, is to provide an improved standing seam roof assembly having improved water resistance of the standing seam.

Yet another object of the present invention, while achieving the above stated objects, is to provide an improved standing seam roof assembly having a positive locking action with improved resistance to joint separation.

A further object of the present invention, while achieving the above stated objects, is to provide an improved standing seam roof assembly that is less costly to fabricate, is more readily installable by semi-skilled workers, and which is less costly to maintain while resisting disengagement of the joint assembly which might occur by joint rotation or moment forces imposed the roof panel.

Other objects, features and advantages of the present invention will become clear from a reading of the following detailed description when read in conjunction with the drawings and appended claims.

DETAILED DESCRIPTION

Figure 1:
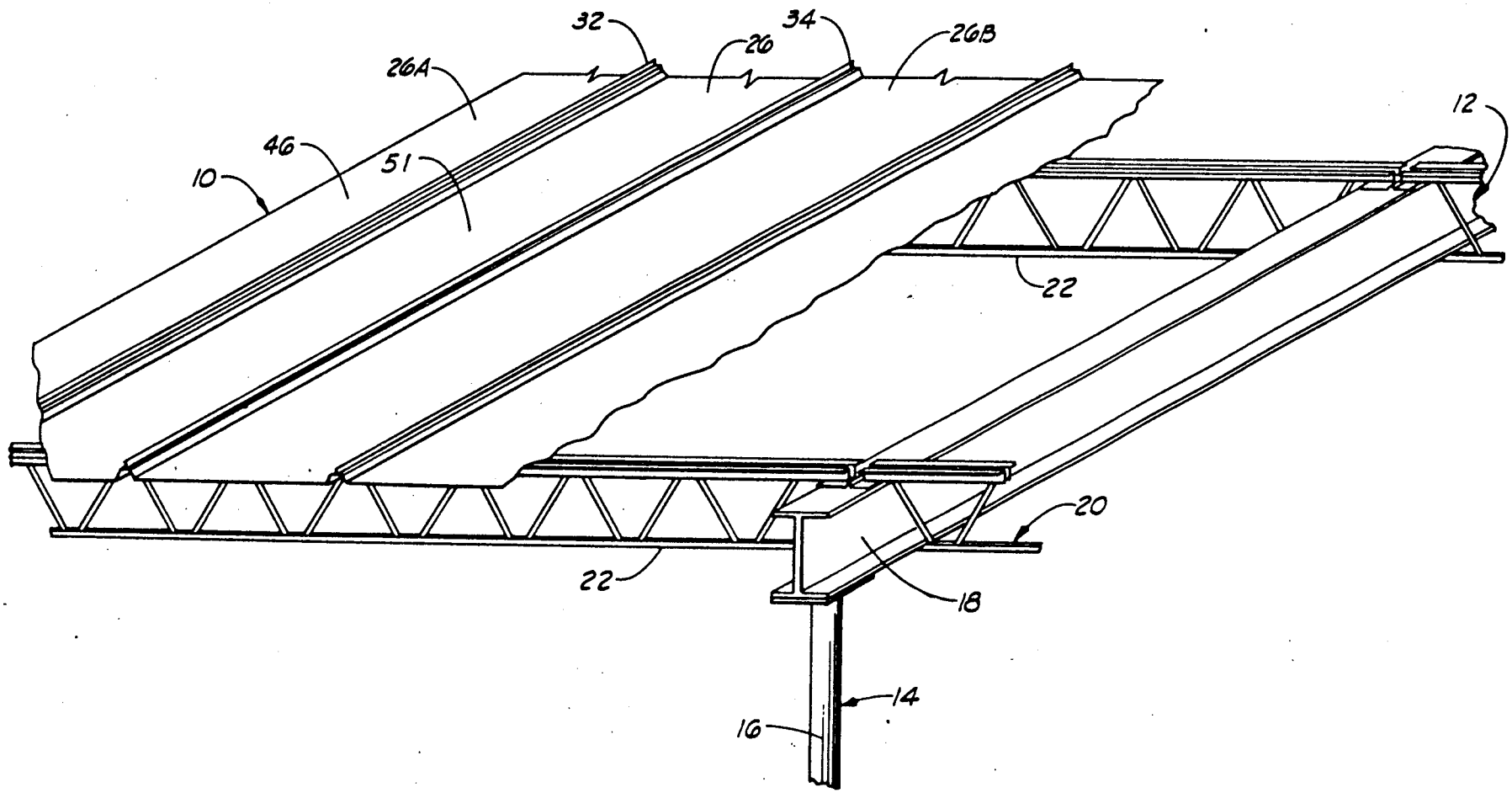
FIG. 1 is a partially broken perspective view of a portion of a standing seam roof assembly.

Referring to the drawings, and more particularly to FIG. 1, illustrated therein is a partial cutaway roof system in which a portion of a pre-engineered building roof 10 is supported by a pre-engineered building structure 12. The pre-engineered structure 12 comprises a primary structural system 14 which consists of a plurality of upperly extending column members 16 and a foundation (not shown) to which the column members 16 are rigidly connected. The primary structural system 14 also includes a plurality of primary beams 18 horizontally disposed and supported by the column member 16.

A secondary structural system 20 comprises a plurality of open web beams or bar joist 22 supported by the primary beams 18. A plurality of roof panels, such as roof panels 26, 26A and 26B, are supported on the secondary structural assembly 20. The roof panels, only portions of which are shown, are standing seam panels with their edge seams interlocked. That is, the roof panel 26 is shown interlocked with a contiguous roof panel 26A on one side by a female/male interlock seam assembly 32 and with a contiguous roof panel 26B on the other side thereof by a male/female interlock seam assembly 34.

The female/male interlock seam assemblies 32, 34 are identical in construction. Thus, only the female/male interlock seam assembly 32 will be discussed in detail hereinafter. However, it should be noted that each of the roof panels has a female side lap joint formed along one side thereof and a male side lap joint formed along the other side.

Referring now to FIGS. 2, 4, 5 and 7, the female/male interlock seam assembly 32 (also referred to herein as a side lap joint assembly) is shown in partial cross-sectional elevational view. The female/male interlock seam assembly 32 is formed by the interlocking engagement of a female side lap joint 36 and a male side lap joint 38 of contiguously placed roof panels 26 and 26A. That is, the roof panel 26A has the female side lap joint 36 formed along one side thereof and the roof panel 26 has the male side lap joint 38 formed along one side thereof.

The female side lap joint 36 is provided with a first leg 40 and a second leg 42 extending therefrom and forming the male receiving cavity 44 therebetween. The first leg 40 extends substantially normal to a medial portion 46 of the panel member 26A (see FIG. 1) and the second leg 42 extends angularly from the first leg 40 and forms a sealant cavity 48 in an apex portion defined by the junction of the first and second legs 40, 42.

Along the opposing side of the roof panel 26 there is formed a female side lap joint which is identical in construction to the female side lap joint 36 of roof panel 26A, it being understood that the female side lap joint along one side of the roof panel 26 is matingly interlocked with a male side lap panel joint of the contiguously placed roof panel 26B. Accordingly, only a description of the female side lap joint 36 of the roof panel 26A and its interlocking relationship with the male side lap joint 38 of the roof panel 26 will be described in detail hereafter. Further it will be understood that each of the roof panels has a medial panel portion similar to the medial portion 46 of the roof panel 26A and the first leg of each of the female side lap joints extends substantially normal (at about a 90° angle) to its medial panel portion; and the first leg of each of the male side lap joints extends substantially normal to its medial panel portion.

The male side lap joint 38 has a first leg 50 that extends substantially normal to the medial panel portion 51 of the roof panel 26 (see FIG. 1), and a second leg 52 that extends angularly from the first leg 50 and forms a sealant engaging apex portion 54 at the juncture of the first and second legs 50, 52. As will be discussed below, the sealant engaging apex portion 54 is provided with a nose-like portion 56 which extends outwardly therefrom and which functions as a sealant engaging hook when the female side lap joint 36 and the male side lap joint 38 are matingly interlocked.

Returning to the female side lap joint 36, the second leg 42 thereof is characterized as having a convex upper portion 60, a substantially linear medial portion 62 and a convex distal end portion 64. The convex upper portion 60 of the second leg 42 cooperates with an upper portion 66 of the first leg 40 so that the sealant cavity 48 defined therebetween is characterized as having a first portion 67 and a second portion 68. The first portion 67 of the sealant cavity 48 is aligned with and openly communicates with the male receiving cavity 44. The second portion 68 of the sealant cavity 48 is offset relative to an upper portion of the male receiving cavity 44 and is adapted to supportingly receive a resilient sealant 70 such that the sealant 70 extends a selected distance into the first portion 67. As will be more fully described hereafter, when the second leg 42 of the female side lap joint 36 (see FIG. 4) is laterally displaced to effect the opening of the male receiving cavity 44, the offset second portion 68 of the sealant cavity 48 is likewise laterally displaced. Thus, the sealant engaging apex portion 54 of the male side lap joint 38 can be inserted into the first portion 67 of the sealant cavity 48 without substantial contact with the sealant 70. Once the male side lap joint 36 has been positioned within the male receiving cavity 44 of the female side lap joint 36, the sealant 70 disposed within the offset second portion 68 of the sealant cavity 48 extends into the first portion 67 of the sealant cavity 48 and substantially encapsulates the nose-like portion 56 of the sealant engaging apex portion 54 of the male side lap joint 38 substantially as shown in FIG. 5.

The medial portion 62 of the second leg 42 of the female side lap joint 36 extends angularly from the convex upper end portion 60 and terminates with the distal end portion 64 which forms a restraining lip 72 extending generally toward the first leg 40 to partially block an opening 74 of the male receiving cavity 44. The restraining lip 72 (which is provided with an arcuate convex configuration substantially as shown) defines a ramp edge 76 adapted to supportingly receive a distal end portion 78 of the second leg 52 of the male side lap joint 38 when the male side lap joint 38 has been positioned within the male receiving cavity 44 of the female side lap joint 36. That is, the restraining lip 72 of the female side lap joint 36 and the distal end portion 78 of the second leg 52 of the male side lap joint 38 cooperate to secure the male side lap joint 38 within the male receiving cavity 44 of the female side lap joint 36 so that the sealant engaging apex portion 54 is disposed at a desired position within the first portion 67 of the sealant cavity 42 and the nose-like portion 56 of the sealant engaging apex portion 54 is in compressive engagement with the sealant 70 disposed within the offset second portion 68 of the sealant cavity 48 and substantially embedded or encapsulated in the sealant 70.

To enhance the integrity of the female side lap joint 36, as well as to prevent deterioration of the female side lap joint 36 due to exposure of edges thereof to the surrounding environment, the convex distal end portion 64 of the second leg 42 is folded inwardly along an interior surface 82 of the medial portion 62 to provide the restraining lip 72 with a hem 84. Thus, the restraining lip 72 is substantially strengthened to prevent variations thereof due to force exerted thereon by the distal end portion 78 of the second leg 52 of the male side lap joint 38 when the male side lap joint 38 is disposed within the male receiving cavity 44 of the female side lap joint 36 and interlocked therein. Further, by folding the convex distal end portion 64 of the second leg 42 of the female side lap joint 36 along the interior surface 82 of the medial portion 62 (as shown) a raw edge 86 of the convex distal end portion 64 of the second leg 42 is disposed inwardly into the male receiving cavity 44 so that the raw edge 86 is not exposed to rain, snow, and other environmental conditions which could lead to its deterioration.

To enhance the integrity of the female/male seam assembly 32, as well as to enhance placement of the male side lap joint 38 within the male receiving cavity 44 of the female side lap joint 36, the second leg 52 of the male side lap joint 38 is provided with a rounded end portion 88 formed by folding the distal end portion 78 of the second leg 52 of outwardly along a medial portion 90 of the second leg 52 substantially as shown. By providing the second leg 52 with the rounded end portion 88 a restraining lip engaging member is formed which can be readily moved along the ramp edge 76 of the restraining lip 72 of the female side lap joint 36 so as to ensure that the male side lap joint 38 is properly positioned within the male receiving cavity 44 of the female side lap joint 36. Further, by folding the distal end portion 78 of the second leg 56 outwardly along the medial portion 90 thereof a raw edge 92 of the distal end portion 78 of the second leg 52 will be disposed within the male receiving cavity 44 of the female side lap joint 36 and thus protected from corrosive elements in the environment.

Referring more specifically to FIGS. 2–4 and 7, the interlocking of the female side lap joint 36 and the male side lap joint 38 will be described. In assembling the female/male interlock seam assembly 32, the female side lap joint 36 is positioned over the male side lap joint 38 which has been previously positioned to rest upon a clip support member 94 (see FIG. 7) so that an upper portion 96 of the clip support member 94 supports the male side lap joint 38 in a conventional manner. That is, the clip support member 94 and its upper portion 96 thereof serve to back up the flexible sheet metal of the male side lap joint 38. It should be noted that because the sealant 70 is supported within the offset second portion 68 of the sealant cavity 48, an air space is provided above the upper portion 96 and the clip support member 94. Thus, the clip support member 94 can be more easily inserted into the first portion 67 of the sealant cavity 48 because one does not have to compress the sealant 70 in order to insert the clip support member 94, and thus the male side lap joint 38, into the male receiving cavity 44 of the female side lap joint 36. Further, because neither the clip support member 94 nor the sealant engaging apex portion 54 of the male side lap joint 38 are required to contract and compress the sealant 70 during insertion of the clip support member 94 or the male side lap joint 38 into the male receiving cavity 4 of the female side lap joint 36, the interlocking of the female side lap joint 36 and the male side lap joint 38 is enhanced and the integrity of the resulting female/male interlock seam assembly 32 is greatly improved.

Figure 2:
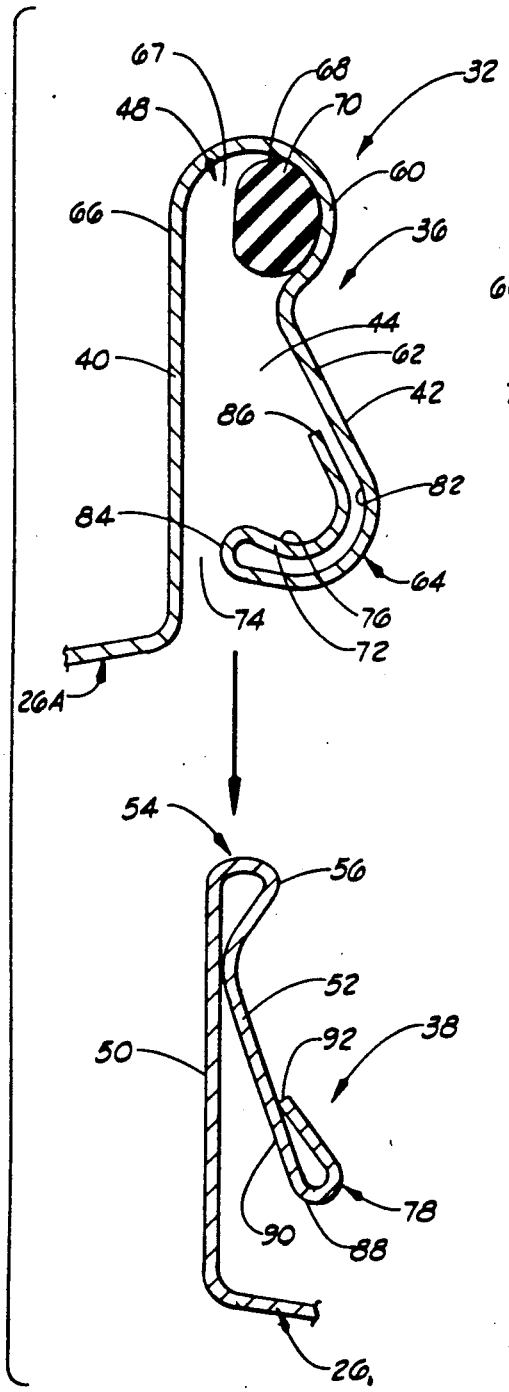
FIG. 2 is an enlarged fragmentary sectional view of the standing seam roof assembly of FIG. 1 illustrating a female side lap joint disposed over a male side lap joint prior to positioning the male side lap joint within a male receiving cavity of the female side lap joint.
Figure 4:
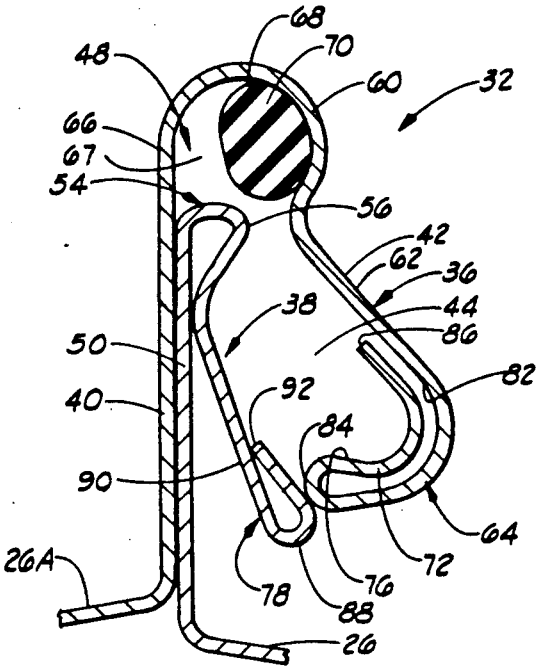
FIG. 4 is an enlarged, fragmentary cross-sectional view illustrating the male side lap joint partially inserted into the male receiving cavity of the female side lap joint.
Figure 5:
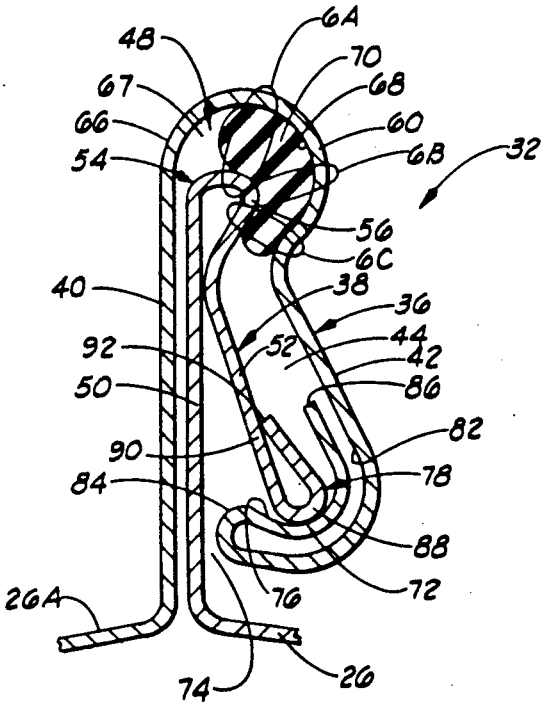
FIG. 5 is an enlarged, fragmentary cross-sectional view of the male side lap joint disposed within the male receiving cavity of the female such that the sealant engaging portion of the male side lap joint is disposed within the first portion of the sealant cavity and embedded in sealant supported in the offset second portion of the sealant cavity.

As more clearly illustrated in FIGS. 2 and 4, when the male side lap joint 38 is inserted into the male receiving cavity 44 the first leg 50 of the male side lap joint 38 is disposed substantially parallel to the first leg 40 of the female side lap joint 36; and the second leg 42 of the female side lap joint 36 is flexed open (i.e. the secondary 42 is displaced laterally in an outward direction from the first leg 40) as the distal end portion 78 of the second leg 52 of the male side lap joint 38 (which also functions as a ramp engaging member) presses against the restraining lip 72 and causes the opening 74 of the male receiving cavity 44 to enlarge to receive the male side lap joint 38. As the second leg 42 of the female side lap joint 36 is flexed open the convex upper end portion 60 defining the offset second portion 68 of the sealant cavity 48 is also flexed laterally so that upon continued insertion of the male side lap joint 38 into the male receiving cavity 44 the sealant engaging apex portion 54 of the male side lap joint 38 can be disposed within the first portion 67 of the sealant cavity 48 without substantial contact with the sealant 70 supported within the offset second portion 68 of the sealant cavity 48. It should be noted that the sealant 70 is supported within the offset second portion 68 of the sealant cavity 48 by three side portions of the convex upper end portion 60 defining the offset second portion 6 of the sealant cavity 48. Thus the positioning of the sealant 70 within the second offset portion 68 of the sealant cavity 48 ensures that the sealant 70 will be laterally displaced in response to lateral displacement of the second leg 42 of the female side lap joint 36.

As the insertion of the male side lap joint 38 within the male receiving cavity 44 continues, the rounded end portion 88 of the distal end portion 78 of the second leg 52 of the male side lap joint 38 (which constitutes a restraining lip engaging member) slidingly moves along the ramp edge 76 defined by the restraining lip 72 until the second leg 42 of the female side lap joint 36 returns to its nonflexed position and the sealant engaging apex portion 54 of the male side lap joint 38 is disposed within the first portion 67 of the sealant cavity 48. When the second leg 40 of the female side lap joint 36 returns to its nonflexed position the sealant 70 disposed within the offset second portion 68 of the sealant cavity 48 is moved into contact with the nose-like portion 56 of the sealant engaging apex portion 54 of the male side lap joint 38 so that the nose-like portion 56 is substantially encapsulated by the sealant 70. Thus, in the assembled position, the female side lap joint 36 and the male side lap joint 38 are fully engaged and locked together so as to prevent separation from either uplifting forces applied to the female side lap joint 36, loads placed on the male side lap joint 38, or thermal expansion and contraction of the panel members and the female/male interlocking seam assembly 32.

As previously stated, the sealant engaging apex portion 54 of the male side lap joint 38 is provided with a outwardly extending nose-like portion 56. The configuration of the sealant engaging apex portion 58, in combination with placement of the sealant 70 within the offset second portion 68 of the sealant cavity 48 provides an improved gasket seal that is continually compressed, whether the panel is at rest, or subjected to live loads or to uplifting forces. Further, when the female side lap joint 36 and the male side lap joint 38 have been properly positioned and interlocked, the resilient sealant 70 is substantially uniformly compressed between the nose-like portion 56 of the sealant engaging apex portion 54 of the male side lap joint 38 and the convex upper end portion 60 of the second leg 42 of the female side lap joint 36 defining the offset second portion 68 of the sealant cavity 48.

Figure 6A:
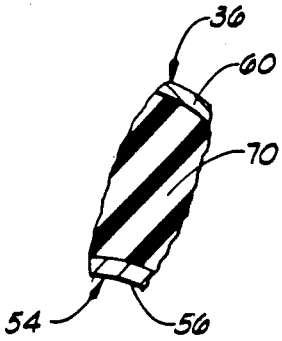
FIG. 6A is an enlarged view of a portion of the standing seam joint assembly at area A in FIG. 5.
Figure 6B:
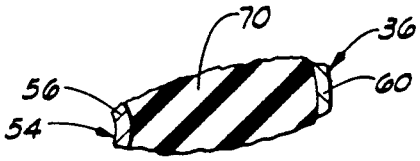
FIG. 6B is an enlarged view of a portion of the standing seam joint assembly at area B in FIG. 5.
Figure 6C:
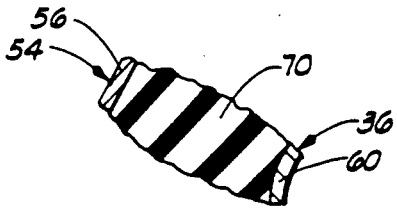
FIG. 6C is an enlarged view of the standing seam joint assembly at area C in FIG. 5.

Compression of the sealant 70 as forces are applied to the female/male interlock assembly 32 depicted in FIG. 5 are schematically illustrated in FIGS. 6A, 6B and 6C. FIG. 6A illustrates compression of the sealant 70 by the sealant cavity defining portion of the female side lap joint 36 and the nose-like portion 56 of the sealant engaging apex portion 54 of the male side lap joint 36 when a downwardly directed load force is applied thereto. FIG. 6B illustrates compression of the sealant 70 by the sealant cavity defining portion of the female side lap joint 36 and the nose-like portion 56 of the sealant engaging apex portion 54 of the male side lap joint 36 when the female/male interlock seam assembly 32 is at rest (i.e. there are no load forces or uplifting forces being applied to the female/male interlock seam assembly 32). FIG. 6C illustrates compression of the sealant 70 by the sealant cavity defining portion of the female side lap joint 36 and the nose-like portion 56 of the sealant engaging apex portion 54 of the male side lap joint 36 when an uplifting force is applied to the female/male interlock seam assembly 32.

Figure 7:
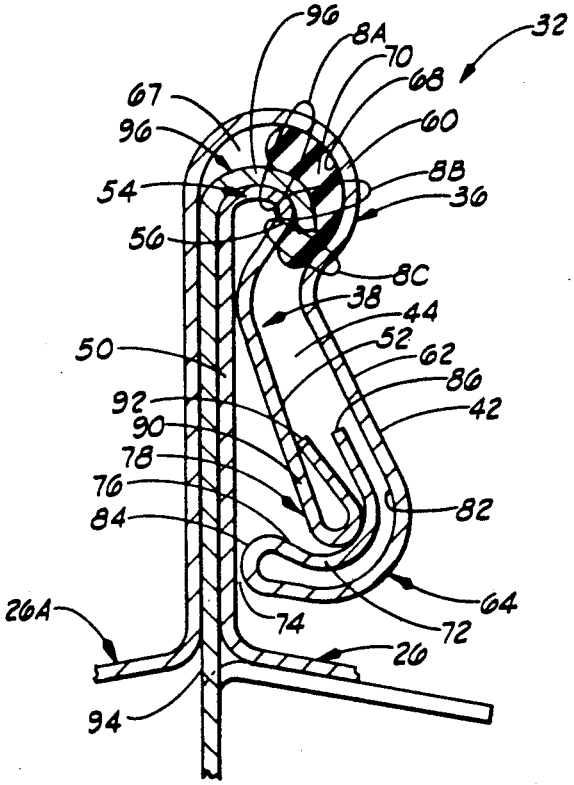
FIG. 7 is an enlarged, fragmentary sectional view of the standing roof assembly having a clip disposed between the female side lap joint and the male side lap joint.
Figure 8A:
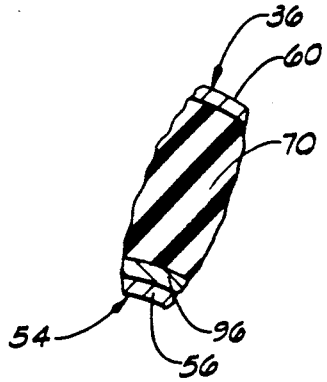
FIG. 8A is an enlarged view of the standing seam assembly at area A in FIG. 7.
Figure 8B:
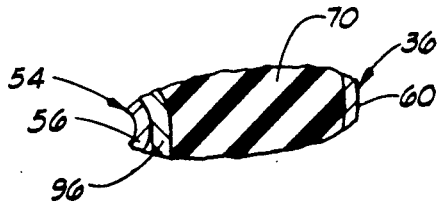
FIG. 8B is an enlarged view of the standing seam joint assembly at area B in FIG. 7.
Figure 8C:
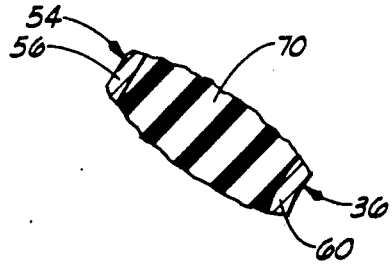
FIG. 8C is an enlarged view of the standing seam joint assembly at area C in FIG. 7.

Similarly, compression of the sealant 70 as forces are applied to the female/male interlock assembly 32 wherein the male side lap joint 38 is supported by the support clip member 94 depicted in FIG. 7 are schematically illustrated in FIGS. 8A, 8B and 8C. FIG. 8A illustrates compression of the sealant 70 by the sealant cavity defining portion of the female side lap joint 36 and the upper portion 96 of the clip support member 94 (and thus the nose-like portion 56 of the sealant engaging apex portion 54 of the side lap member 36) when a downwardly directed load force is applied thereto. FIG. 8B illustrates compression on the sealant 70 when the female/male interlock seam assembly 32 is at rest. FIG. 8C illustrates compression of the sealant 70 by the sealant cavity defining portion of the female side lap joint 36 and the nose-like portion 56 of the sealant engaging apex portion 54 of the male side lap joint 36 when an uplifting force is applied to the female/male interlock seam assembly 32.

The unique design and configuration of the female side lap joint 36 and the male side lap joint 38, as well as the locking engagement therebetween, prevent the relative movement between the female side lap joint 36 and the male side lap joint 38 from reducing the sealant compressive forces while maintaining the sealant 70 in a continually compressed state when the roofing panels are at rest, or when such roofing panels are subjected to live loads or to uplifting forces. Further, the unique design of the sealant cavity 48, including the first portion 67 and the offset second portion 68 thereof, in combination with the configuration of the sealant engaging apex portion 54 of the male side lap joint 38, provide a hooking action between the resilient sealant 70 and the outwardly extending nose-like portion 56 of the sealant engaging apex portion 54 of the male side lap joint 38 when the male side lap joint 38 is in locking engagement with the female side lap joint 36.

Figure 3A:
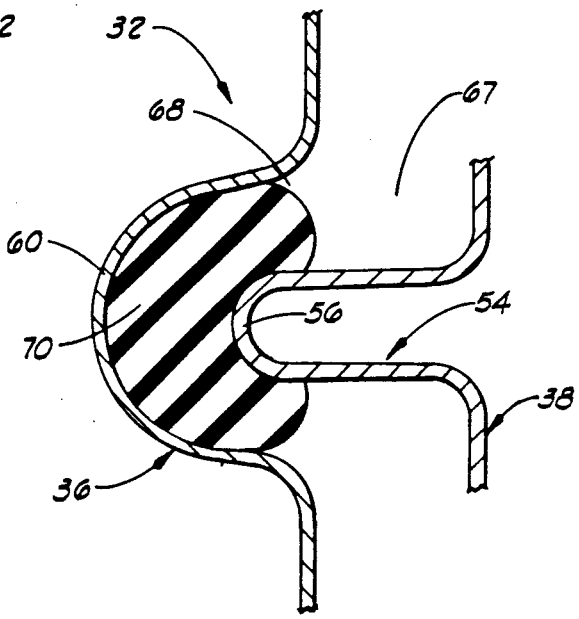
FIG. 3A is an enlarged, fragmentary cross-sectional view of a sealant engaging portion of the male side lap joint disposed within a first portion of a sealant cavity and embedded in a sealant supported within a second portion of the sealant cavity.
Figure 3B:
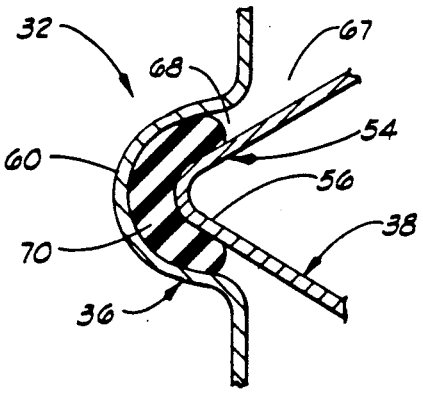
FIG. 3B is an enlarged, fragmentary cross-sectional view of a second embodiment of a sealant engaging portion of the male side lap joint disposed within a first portion of the sealant cavity and embedded in a sealant supported within a second portion of the sealant cavity.

The embedding of the outwardly extending nose-like portion 56 of the sealant engaging apex portion 54 in the sealant 70 is illustrated in FIG. 3A and 3B wherein the sealant engaging apex portion 54 is illustrated as having different cross-sectional configurations. That is, in FIG. 2A the nose-like portion 56 of the sealant engaging apex portion 54 is depicted as having a substantially oval shaped cross-sectional configuration; whereas, in FIG. 3B the nose-like portion 56 of the sealant engaging apex portion 58 is depicted as having a substantially triangular-shaped configuration. It should be noted that, in either case, the overall configuration of the sealant engaging apex portion 54 of the male side lap joint 42 is provided with the nose-like portion 56 so as to provide a hooking action with the resilient sealant 70 when the female side lap joint 36 and the male side lap joint 38 are in locking engagement.

From the above, it becomes clear that the improved standing seam assembly of the present invention has many advantages over the standing seam assemblies of the prior art. For example, because of the unique design and configuration of the female side lap joint 36 and the male side lap joint 38, sealant bead sized tolerances are less critical than with prior art standing seam assemblies. Further, the placement of the sealant 70 in the offset second portion 68 of the sealant cavity 48, in combination with the design of the offset cavity 68 and the sealant engaging apex portion 54 of the male side lap joint 38 ensure that the sealant 70 becomes a part of the structural couple by acting as a compression gasket between the nose-like portion 56 of the sealant engaging apex portion 54 of the male side lap joint 38 and the upper end portions of the first and second legs, 40, 42 of the female side lap joint 36. In addition, once interlocked, the male side lap joint 38 is structurally coupled to the female side lap joint 36 by direct metal contact between the second leg 52 of the male side lap joint 38 and the restraining lip 72 of the female side lap joint 36.

It is clear that the present invention is well adapted to carry out the objects and obtain the ends and advantages mentioned as well as those inherent therein. While presently preferred embodiments of the invention have been described for purposes of this disclosure, numerous changes may be made which will readily suggest themselves to those skilled in the art and which are encompassed within the spirit of the invention disclosed and as defined in the appended claims.

What is claimed is:

1. An improved standing seam for connecting contiguous panels to form a standing seam roof assembly comprising:

a female side lap joint formed along one side of each of the panels, the female side lap joint having a first leg extending substantially normal to a medial panel portion and a second leg angularly extensive from the first leg and forming a male receiving cavity therebetween and a sealant cavity in an upper end portion thereof, the sealant cavity having a first portion and a second portion, the first portion openly communicating with the male receiving cavity and the second portion offset relative to an upper portion of the male receiving cavity, the second portion adapted to supportingly receive a sealant therein such that the sealant extends a selected distance into the first portion, the second leg having a distal end portion forming a restraining lip extending generally toward the first leg to partially block the opening of the male receiving cavity; and a male side lap joint formed along an opposed side of each of the panels, the male side lap joint having a first leg extending substantially normal to the medial panel portion and a second leg angularly extensive from the first leg and forming a sealant engaging apex portion at the junction of the first and second legs, the sealant engaging apex portion having a protruding portion extending outwardly therefrom which functions as a sealant engaging hook, the second leg further characterized as having a distal end portion defining a restraining lip engaging member, the male side lap joint matingly receivable by the female side lap joint of a contiguously disposed metal panel, the male side lap joint insertable into the male receiving cavity when the second leg of the female side lap joint is moved laterally so that the sealant engaging apex portion of the male side lap joint extends into the first portion of the sealant cavity substantially unrestricted by sealant disposed within the second portion of the sealant cavity until in an assembled position wherein the restraining lip engaging member of the second leg of the male side lap joint abuttingly engages the restraining lip of the female side lap joint and thereby interlocks the male side lap joint and the female side lap joint so that the sealant engaging apex potion of the male side lap joint is disposed within the first portion of the sealant cavity and the protruding portion of the sealant engaging apex portion is brought into compressive engagement with sealant disposed within the second portion of the sealant cavity and at least the protruding portion of the sealant engaging apex portion of the male side lap joint is substantially encapsulated by sealant and forces applied to the standing seam compress the sealant to enhance seam integrity.

2. An improved standing seam of claim 1 wherein the second leg of the male side lap joint is further characterized as having a medial portion and wherein the distal end portion is folded outwardly along an outer surface of the medial portion to provide the second leg with a rounded end portion to enhance sliding engagement with the restraining lip of the female side lap joint.

3. An improved standing seam of claim 2 wherein the second leg of the female side lap joint is further characterized as having a medial portion and wherein the distal end of the second leg is folded inwardly along an interior surface of the medial portion to provide a hem at a distal end of the restraining lip.

4. An improved standing seam of claim 1 further comprising a resilient sealant supported within the second portion of the sealant cavity.

5. An improved standing seam of claim 4 wherein the second leg of the female side lap joint is characterized as having an upper end portion defining the second portion of the sealant cavity and wherein the upper end portion has a convex configuration.

6. In a standing seam roof assembly formed of a plurality of metal panels in side by side contiguous relationship with interlocking side lap joint portions, an improved female/male interlock seam assembly formed by the interlocking engagement of contiguous panels wherein each panel comprises:

a female side lap joint formed along an elongated edge of each of the panels, the female side lap joint having a first leg extending substantially normal to a medial panel portion and a second leg angularly extensive from the first leg and forming a male receiving cavity therebetween and a sealant cavity in an upper portion thereof, the sealant cavity having a first portion and a second portion, the first portion aligned with the male receiving cavity and the second portion offset relative to the male receiving cavity, the second portion adapted to support a resilient sealant therein, the resilient sealant movable laterally in response to lateral movement of the second leg to provide substantially unrestricted access to the first portion of the sealant cavity when the male receiving cavity is opened to a male receiving position, the second leg having a distal end portion forming a restraining lip extending generally toward the first leg to partially block the opening of the male receiving cavity; and a male side lap joint formed along the other elongated edge of each of the metal panels, the male side lap joint having a first leg extending substantially normal to the medial panel portion and a second leg angularly extensive from the first leg and forming a sealant engaging apex portion having a substantially inverted tear-drop configuration formed at the junction of the first and second legs, the second leg further characterized as having a distal end portion defining a restraining lip engaging member, the male side lap joint matingly receivable by the female side lap joint of a contiguously disposed metal panel, the male side lap joint insertable into the male receiving cavity when the second leg of the female side lap joint is moved laterally so that the sealant engaging apex portion extends into the first portion of the sealant cavity substantially unrestricted by resilient sealant disposed within the second portion of the sealant cavity until in an assembled position wherein the restraining lip engaging member of the second leg of the male side lap joint abuttingly engages the restraining lip of the female side lap joint and thereby interlocks the male side lap joint and the female side lap joint so that the sealant engaging apex portion of the male side lap joint is secured within the first portion of the sealant cavity and into compressive engagement with resilient sealant disposed within the second portion of the sealant cavity so that at least a portion of the sealant engaging apex portion of the male side lap joint is substantially encapsulated by resilient sealant.

7. In a standing seam roof assembly of claim 6 wherein the second leg of the female side lap joint is characterized as having an upper end portion defining the second portion of the sealant cavity and wherein the upper end portion has a convex configuration.

8. In a standing seam roof assembly of claim 6 wherein the second leg of the male side lap joint is further characterized as having a medial portion and wherein the distal end portion thereof is folded along an outer surface of the medial portion to provide the second leg with a substantially rounded restraining lip engaging end.

9. In an standing seam roof assembly of claim 6 wherein the second leg of the female side lap joint is further characterized as having a medial portion and wherein the distal end portion is folded inwardly along an interior surface of the medial portion to provide a hem at a distal end of the restraining lip.

* * * * *

UNITED STATES PATENT AND TRADEMARK OFFICE

CERTIFICATE OF CORRECTION

PATENT NO. : 5,038,543

DATED : August 13, 1991

INVENTOR(S) : Leo E. Neyer

It is certified that error appears in the above-identified patent and that said Letters Patent is hereby corrected as shown below:

Title page, [56] References Cited, after "4,269,012" delete "6/1981" and substitute therefor --5/1981--;

Column 7, line 25, delete "4" and substitute therefor --44--;

Column 7, line 54, delete "6" and substitute therefor --68--;

Column 10, line 51, delete "potion" and substitute therefor --portion--;

Signed and Sealed this

Twenty-third Day of November, 1993

Bruce Lehman

*Attest:*

BRUCE LEHMAN

*Attesting Officer*

*Commissioner of Patents and Trademarks*